United States Patent [19]

Gunther, Jr.

[11] Patent Number: 4,989,852

[45] Date of Patent: Feb. 5, 1991

[54] ELECTRONIC PUBLISHING SYSTEM

[75] Inventor: William H. Gunther, Jr., Mystic, Conn.

[73] Assignee: Gunther International, Ltd., Mystic, Conn.

[21] Appl. No.: 464,318

[22] Filed: Jan. 12, 1990

Related U.S. Application Data

[63] Continuation of Ser. No. 314,086, Feb. 23, 1989, abandoned, which is a continuation of Ser. No. 58,183, Jun. 4, 1987, abandoned.

[51] Int. Cl.[5] ..... B65H 43/02

[52] U.S. Cl. ..... 270/56; 270/53; 270/58; 270/54; 364/471

[58] Field of Search ..... 270/52, 53, 54, 55, 270/56, 57, 58; 364/471, 478; 53/266 A, 540

[56] References Cited

U.S. PATENT DOCUMENTS

| | | | |
|---|---|---|---|
| 3,606,728 | 9/1971 | Sather | 270/57 |
| 4,500,083 | 2/1985 | Wong | 270/54 |
| 4,515,356 | 5/1985 | Mullritter | 270/53 |
| 4,582,312 | 4/1986 | Abrams | 270/58 |
| 4,585,220 | 4/1986 | Zemke | 270/54 |
| 4,778,167 | 10/1988 | Snow | 270/53 |
| 4,789,147 | 12/1988 | Berger | 270/54 |

OTHER PUBLICATIONS

Harris, Saddle-Stitch Binding Systems, Harris Corporation, 2-22-83.

*Primary Examiner*—Edward K. Look
*Assistant Examiner*—Therese M. Newholm
*Attorney, Agent, or Firm*—Stoll, Previto & Hoffman

[57] ABSTRACT

Mechanism for assembling a document from a plurality of predetermined sheets having a central controller, with a plurality of modules. The sheets are moved past each of said modules. One of said modules is a feed module which feeds the sheets. The feeder module has reader means for reading each sheet before it is fed and being positioned adjacent the sheet feeder so that it reads the lower-most sheet in the feeder. A module is also provided for assembling the sheets together. Means are also provided responsive to the central controller which stop the operation of the mechanism should the sheet read by the reader be the improper sheet for the document being assembled.

11 Claims, 1 Drawing Sheet

ELECTRONIC PUBLISHING SYSTEM

RELATED APPLICATION

This application is a continuation of pending U.S. Application Ser. No. 314,086, filed Feb. 23, 1986, abandoned, which in turn, was a continuation of U.S. Pat. Application Ser. No. 58,183 filed June 4, 1987, abandoned.

DESCRIPTION

The present invention is directed to an Electronic Publishing System and more particularly to an Electronic Publishing System which will automatically assemble various predetermined pages to form a completed document ready to be mailed.

The new generation of laser printers has accelerated the trend to electronic publishing. The ability to produce documents at a reasonable price "on demand" is replacing the costly printing, sorting, and rapid obsolescence of preprinted material. However, the time-consuming manual assembly and binding of the completed document, has not disappeared with electronic publishing.

The present invention provides a computer-controlled machine which takes the sheets from high speed laser printers and makes a finished document. This automated system has been developed to take output from printers and process it quickly, efficiently and accurately. The modular design concept can take the printer output, validate the sequence and package completeness, add covers and inserts if required) bind the material together in a variety of ways, combine groups of documents, and place them together in a package (banded, boxed or enveloped). Typical documents that can be assembled an finished on the system are insurance policies, contracts, instructional materials, parts and repair manuals, business reports of all kinds. If the information is in a computer and can be printed, the system of the present invention can put it together and place it in the proper package.

A number of companies, such as insurance companies, have standard documents or contracts which they send to their accounts or to others throughout the country. In the case of insurance companies, the laws of the various states require certain clauses to be used in certain types of insurance polices. Thus, the policy for one state would require a predetermined number of sheets containing these clauses whereas the policy for another state would require a different set of sheets containing different clauses. Hence, in order for insurance policies to be issued in all the states, insurers have had to determine what particular clauses are required in each state and have had to either manually, or by some other means, compile the various documents. Thereafter it has been necessary for the documents to be mounted together and shipped. Since a policy in a particular state would be flawed, if not invalid, if all the proper clauses were not included therein, it is imperative that insurance companies issue such policies with all the proper pages with the proper clauses included in the finished product. In the past, the policies have had to be checked manually. This resulted in extremely costly and slow processes even though some errors were made.

The present invention overcomes these difficulties and has for one of its objects the provision of an improved system for producing a finished product, such as an insurance policy, which will automatically assemble all the desired pages containing the proper clause together, staple or otherwise bind them together, place them in envelopes, the mail them.

the present invention accomplishes this by the use of various modules, each of which performs a particular function. The various modules many be interchanted and may or may not be used in a particular situation, but preferably, they are all available if needed. The modules may consist of a Sheet Feed Module, a Cover Feed Module, an Insert Module, a Stapler Module, a Plastic Binder Module, an Accumulating/Diverting Conveyor Module, a large Envelope Module, a Boxing/Binding Shrink Wrap Module, and a Product Orientation and Postable Meter BAse Module.

It is an object of the present invention to provide a mechanism and system for automatically preparing a document having all the necessary pages therein.

Another object of the present invention is an improved mechanism and system for preparing a document which will automatically assemble the proper pages which are to be used in the document.

Another object of the present invention is the provision for an improved mechanism and system for preparing a document where the mechanism will automatically bind the document together, add a cover to it, if required, and insert the document in a mailing envelope.

Other and further objects of the invention will be obvious upon an understanding of the illustrative embodiment about to be described or will be indicated in the appended claims, the various advantages not referred to herein will occur to one skilled in the art upon employment of the invention in practice.

A preferred embodiment of the invention has been chosen for purposes of illustration and description and is shown in the accompanying drawings forming a part of the specification wherein.

Figure 2:
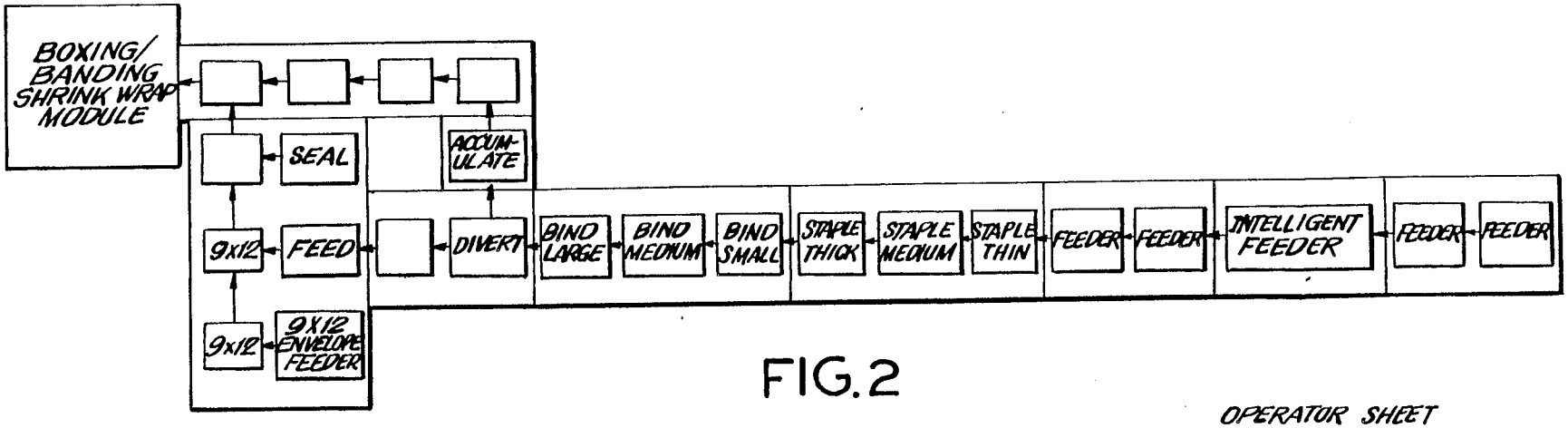
FIG. 2 is a diagrammatic top view thereof.
Figure 1:
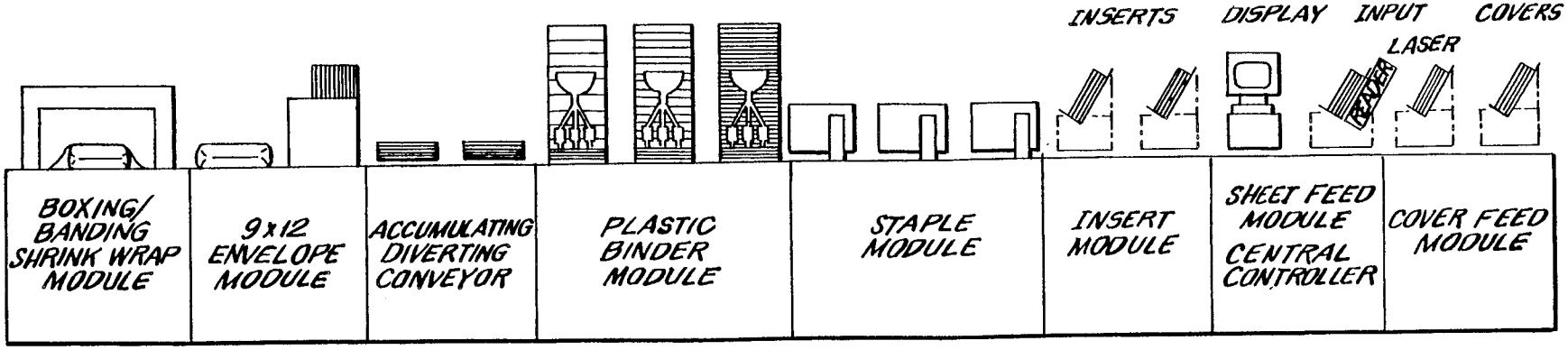
FIG. 1 is a diagrammatic elevational side view of the preferred embodiment of the present invention.

Referring to the drawings, the present invention comprises a conveyor shown diametrically as an arrows which indexes instep-by-step fashion from module to another.

The Modules of the present invention comprise a Cover Feed Module which includes a set of cover feeders which feed covers to the conveyor if a cover is needed. The conveyor then moves over a Sheet Feeder Module which has a sheet input laser reader and feeder. The laser reader is adapted to read the lowermost of a stack of sheets or pages. As each sheet is read, the sheet is fed to the conveyor and is noted on the central controller. The reader accomplishes the task of making certain that all the sheets which are fed are the proper ones for the particular document being assembled.

Part of the Sheet Feeder Module includes a central controller unit with a visual operator display. The central controller is adapted to store all the information necessary for assembling a particular type of document. When the reader reads the information on each sheet, that information is compared with previously stored data in the central controller to be certain that he proper sheet is being fed. If there is a malfunction, the central controller will stop the machine and the operator display will indicate where the malfunction is occurring so that it can be corrected.

The conveyor then moves the previously fed sheets to an insert module where other inserts may be added to the document, depending on the type of document which is being assembled. Again, these inserts are fed from the bottom and are fed through feed trays.

The conveyor then diverts the document to a Staple Module where a plurality of Staplers are mounted to staple the documents together. Depending on the thickness of the document, a particular size staple gun is activate as controlled by the central controller. After stapling, the sheets are moved to a plastic binder module which binds the assembled sheets in the plastic binder to complete the document. In the embodiment shown, three binders are used for large, medium and small documents, again depending upon the thickness as controlled by the central controller. If desired, for certain types of documents where a plastic binder is not necessary, this plastic binder can be eliminated completely or merely bypassed and not activated.

The conveyor then moves the document to a diverting and accumulating module which diverts certain types of documents to an envelope or directs other types of documents to a Boxing/BAnding/Shrink Wrap Module. If the document is to be placed in an envelope, the diverter is not activated and the document is mowed to an Envelope Module which places the document in a properly sized envelope, seals it and sends it on to the last module.

If the documents are to be accumulated, then the diverter is activated and after the proper accumulation, the documents are fed by a second conveyor to be boxed, banded or shrink/wrapped depending on the type of shipping carton desired. In the Boxing/Banding/Shrink Wrap Module, the documents are either boxed, wrapped with a band, or shrink/wrapped prior to shipment. If desired, and if the documents are to be mailed, the last module may feed into a stamping and mailing module which is not shown. Again, if desired, for certain documents, the operation of accumulating envelopes and boxing, banding or shrink/wrapping, and the mailing modules may either be eliminated or not activated.

The sheet Feed Module includes an input feeder in which the sheets are placed face down in a stack as they come out of a printer (not shown). The sheets are provided with bar codes which are adapted to direct the controller to give the proper commands. The bar code on the first sheet (lowermost) is scanned by also reader to determine what pages the finished product will contain, what other components will constitute the makeup of the finished product and what functions of the total system will be activated to form the desired finished product. The document, page and/or sequence number for each sheet is read by the laser reader and validated before it is fed onto the indenting conveyor. Any improper sheet is displayed on the operator display and the system will stop to permit the necessary correction to be made. There is not possibility that a wrong sheet can get into a document if the bar code on the lowermost sheet and the data on the other sheets is correct. The cycling speed of the system is about 7,500 sheets per hours which is faster than any existing system.

If the central controller determines that the finished product requires a cover, the cover feed module is activated to feed a cover to the indexing conveyor from a stack of covers on one or more feeders. The cover is then advanced by the conveyor until it is under the sheet input unit in the Sheet Feed Module. All sheets of a particular document are then fed on top of the front cover which has been previously fed to the conveyor. The conveyor is then advanced to an Insert Module for a back cover or other optional sheets to be added. AS the first document is being processed and completed, the system can start processing additional documents so that there is not time loss in continuously processing a variety of different documents.

The insert Module is provided to add to the document packages of preprinted information, advertising, marketing and book cover sheets. It can also provide the receiver of the documents with other mailings at not additional mailing costs.

The documents are then moved to the Stapler Module which holds the document together by applying the proper size staple for a particular thickness. Three different size staples are available to handle from two through large numbers of sheets The central controller makes the decision as to which staple to use based upon the sheet count in the document and any bar code instructions read by the reader. The three sizes avoid any overlap of the legs of the staple and provide adequate leg length to give a strong binding.

The document is then moved to the Plastic Binder Module if a plastic binder is required. This module places a rectangular plastic binder over along edge of the document. The document sheets rae jogged to align them and are held in place to maintain accurate alignment. Those documents that have received covers can be bound or staples depending upon the type of document which the central controller requires.

In the preferred embodiment, a plastic binder (not shown) is pushed over the sheets and three plastic pins are inserted through the holes in the paper and in the binder to finish the document. There ar three sizes of binders to accommodate documents from a few sheets up to approximately one hundred and fifty sheets If the document is to go into a flat envelope, it is advanced directly by the indexing conveyor through the Diverting Conveyor and into the feed station of a 9×12 Envelope MOdule. The 9×12 Envelope Module has an envelope feeder and a sealer. The 9×12 Envelope Module places documents in a pocket in the envelope in which the flap is along the short side. The envelopes can range in size from $8\frac{3}{4}\times11\frac{1}{4}$ inches to 10×13 inches. The envelopes are placed upright on their short ends with the open side up. They are fed one by one to the insertion station. The envelope is opened and a receiving shoe (not shown) is slid into the envelope to form an easy entry. After insertion, the envelope is moved to the sealing station where its pressure sensitive adhesive flap is shut. If the document is too large for a 9×12 envelope (over twelve ounces), the document is diverted by the diverting conveyor at right angles onto the accumulator conveyor. Large documents are overlapped or shingled and the conveyor is advanced to separate each large document places on the conveyor.

The system may be provided with Boxing/Banding Shrink Wrap Module. This module may be added to the Accumulating Diverting Conveyor Module to band together up to six inches of documents. This module can perform single or multiple functions. The module may be adapted to perform boxing, banding or shrink wrapping as may be desired. For banding, the document is fed into the throat of a bander (not shown) and a plastic band is automatically placed around the document. These documents exit to a conveyor of shipping. The boxing and shrink wrap functions are semi-automatic to allow for size variations. However, fixed sized packages can be fully automated. This module may also be taken out of line so as to perform its functions as a stand-alone or off-lien module.

The package may then feed to a Product Orientation and Postage Meter Base Module (not shown) which will receive the envelope from the 9×12 module, orient it for the postage meter and apply the correct postage. The Central Controller may also be programmed to keep track of the number of sheets to calculate the weight of the document and to apply the correct postage. The weigh of each document and envelope is calculated and recorded by the controller.

Optimally, a printed output with a printer may be provided to the Postal Service of Documentation of postal fees, which would eliminate the necessity for a Postage Module.

This invention has been described with respect to a number of modules which act together in order to perform certain functions. AS has already been explained above, it is within the purview of this invention that any selected module can be removed from the others or inactivated should a particular function of the system need not be performed on that particular document.

It will also be understood that it is also within the purview of the present invention for the individual modules to be used with other modules which are not shown or disclosed in this application and which perform functions different from the functions described in this application. For example, the Sheet Feed Module may be used to feed and monitor sheets for purposes other than the ones that are described in this application, such as employee profiles. Likewise, any of the other modules may be used with other machinery or systems quite different from the one described wherein. It will be seen that each individual module shown and described in this patent application may be used independently of the other modules when and described herein and may be used with other machines to perform functions different from the functions shown and described in this application.

This ability of reach module to be used independently of the particular modules shown and described in this applications gives this system great versatility. It is now possible for modules to be kept in reserve and merely used in a particular application to perform particular function. In other words, the modules may be moved from one location to another or from one system to another and still retain their original functional integrity.

It will thus be seen that the present invention provides an improved mechanism and system which will automatically prepare a document having all the necessary pages therein, which will automatically assemble together the proper pages which are to be used in the document and which will automatically bind the document together, add a cover to it, if required, and insert the document in a mailing envelope and mail it, if required and which is versatile so that he individual modules may be used without modules which perform functions different from the ones shown and described herein.

As many and varied modifications of the subject matter of this invention will become apparent to those skilled in the art from the detailed description given hereinabove, it will be understood that the present invention is limited only as provided in the claims appended hereto.

The embodiments of the invention in which an exclusive property or privilege is claimed are defined as follows:

1. A mechanism for processing a document having at least one pre-printed sheet with information data thereon, which comprises a central controller having stored therein information comparison data necessary to process said document a feeder module, said feeder module having feeder means to receive a plurality of sheets in a stack and to feed said sheets one-by-one from said stack, means operatively associated with said feeder module for reading information data on each sheet before each sheet is fed from said stack, the information data on the first sheet of said stack being at least partial instructions to the central controller as to the manner of processing said document, said reader being positioned adjacent the feeder means so that it reads the information data on a sheet in the stack before the sheet is fed from the stack, means for comparing the information data read on each sheet with the information comparison data in the central controller to determine whether the proper sheet will be fed from the stack, means responsive to the central controller and adapted to stop the operation of the mechanism and to prevent the feed of a sheet from the stack if the information data on the sheet does not match with the information comparison data in the central controller processed, and means controlled by the central controller to process said document in a predetermine manner responsive to the partial instructions received by the central controller from said first sheet.

2. A mechanism as set forth in claim 1 wherein a cover feed module is provided and adapted to feed a cover for the document.

3. A mechanism as set forth in claim 2, wherein an insert module is provided to feed additional inserts to the document.

4. A mechanism as set forth in claim 3, wherein a staple module is provided to staple the various sheets together.

5. A mechanism as set forth in claim 4, wherein a plurality of stapling mechanisms are provided it the staple module any predetermined one of which is adapted to be activated depending on the thickness of the document.

6. A mechanism as set forth in claim 4, wherein a binder module is provided to add binder means to the document.

7. A mechanism as set forth in claim 6, wherein a plurality of hinder means are provided on the binder module, said binder means being of different sizes, the proper size binder being fed depending on the thickness of the document.

8. A mechanism as set forth in claim 6, wherein an accumulating diverter module is provided to accumulate and/or divert the sheets of the document.

9. A mechanism as set forth in claim 8, wherein an envelope module is provided to permit documents received from the module to be placed in an envelope.

10. A mechanism as set forth in claim 9, wherein a banding/boxing and shrink wrap module is provided to receive the documents from the envelope module or the accumulating/diverting module.

11. A mechanism as set forth in claim 1 wherein said document comprises a plurality of sheets, means for assembling the sheets together to form the document, a plurality of modules being provided in said mechanism, one of said modules being said feeder module, means for moving said sheets past said modules, said reader being positioned adjacent said feeder means so that its reads the lower-most sheet in said stack of sheets.

* * * * *